United States Patent [19]

Yoshida

[11] 4,441,351

[45] Apr. 10, 1984

[54] METHOD OF AND APPARATUS FOR PRODUCING METALLIC TAPE

[76] Inventor: Keiichiro Yoshida, No. 641, Mobara, Mobara City, Chiba Prefecture, 297, Japan

[21] Appl. No.: 361,489

[22] Filed: Mar. 24, 1982

Related U.S. Application Data

[62] Division of Ser. No. 178,635, Aug. 15, 1980.

[30] Foreign Application Priority Data

Oct. 31, 1979 [JP] Japan ..... 54-141881

[51] Int. Cl.[3] ..... B21B 13/18

[52] U.S. Cl. ..... 72/189; 72/252

[58] Field of Search ..... 72/189, 199, 207, 222, 72/214, 250, 252, 365, 366, 406, 428

[56] References Cited

U.S. PATENT DOCUMENTS

| | | | |
|---|---|---|---|
| 614,111 | 11/1898 | Johnston | 72/222 |
| 1,429,352 | 9/1922 | Janke | 72/214 |
| 2,092,188 | 9/1937 | Simons | 72/199 |
| 2,325,373 | 7/1943 | Corsini | 72/222 |
| 2,582,576 | 1/1952 | Zweyer | 140/90 |
| 3,102,443 | 9/1963 | Dell et al. | 72/189 |
| 4,028,924 | 6/1977 | Calevich et al. | 72/252 |

*Primary Examiner*—Lowell A. Larson

*Attorney, Agent, or Firm*—Wenderoth, Lind & Ponack

[57] ABSTRACT

A method of producing a continuous metallic tape from a metallic material wire by rolling. A wire having any desired cross-sectional shape is fed into the gap between a pair of rolls in a direction parallel to the axes of the rolls. The rolls are adapted to be reciprocatingly rotated or oscillated through a predetermined angular stroke. Guide members are provided at the material wire inlet side and the product tape outlet side for shifting the wire and the tape in a direction perpendicular to the direction of feed reciprocatingly and in synchronism with the rotation of the rolls. Pinch rolls are provided for intermittently feeding the wire when the latter is out of the area of rolling pressure.

3 Claims, 21 Drawing Figures

METHOD OF AND APPARATUS FOR PRODUCING METALLIC TAPE

This application is a division of application Ser. No. 178,635, filed Aug. 15, 1980, now pending.

BACKGROUND OF THE INVENTION

1. Field of the Invention

The Present invention relates to a method of producing a metallic tape from a round or square metal wire by rolling, characterized in that the wire from which the tape is rolled is fed in a direction perpendicular to the rolling direction.

2. Description of the Prior Art

Hitherto, there have been proposed and actually used various methods of producing metallic tape. For instance, it is known to form the metallic tape from a round or square wire by rolling. Another known method is to cut a thin metallic sheet into tapes of a predetermined width.

In the first method, the material is fed in the same direction as the direction of rolling, and the relationship exists among the diameter d of the wire and the breadth b, and thickness t of the metallic tape produced as shown in the following formula:

$$d=(b+t)/2\times(0.9\sim1.1)$$

Therefore, it is necessary to use a round wire of 10 mm dia. for obtaining a metallic tape having a breadth of 20 mm and a thickness of 1 mm.

In the said method, however, the longitudinal sides of the product are undesirably corrugated or cracked which degrades the quality of the tape. In addition, the structure of the product in the cross-section perpendicular to the longitudinal sides is unstabilized. For these reasons, the product formed by this known method has only a limited use. For instance, this product cannot be used as a material for drawing work.

In the second method, a large expensive installation is necessary for forming the sheet of metallic material resulting in a high price of the tape. In addition, the cut tape pieces have to be sucessively connected in series for obtaining a product having a great length. Thus, it is difficult to use the said method in practice.

SUMMARY OF THE INVENTION

It is, therefore, an object of the invention to overcome the above-described problems of the prior art.

To this end, according to an aspect of the invention, there is provided a method of producing a metallic tape by rolling wherein the material to be rolled is fed in a direction perpendicular to the direction of the rolling.

An apparatus for carrying out the method has: a rolling device including a pair of sector rolls rotatably carried by shafts extending in parallel with the direction of movement of the material to be rolled; a driving device for driving the rolling device; a guiding device for guiding the material at the inlet and outlet sides during a reciprocating rolling operation; and a feeding device for feeding the material at a constant stroke.

With the method of the invention as practiced on the apparatus having the above-described features, it is possible to roll the material into a metallic tape having a predetermined breadth and devoid of any corrugation and cracking in the longitudinal sides thereof. In addition, it has been confirmed that the workability is very much improved. The pair of sector rolls are adapted to be driven reciprocatingly in synchronization by the driving device and a part of this reciprocating power is utilized as the power for intermittent feed of the material.

BRIEF DESCRIPTION OF THE DRAWINGS

FIGS. 1 to 3 show the principle of the invention in relation to the operation of a pair of rolls in which;

FIG. 1 is a front elevational view of the rolls;

FIG. 2 is a side elevational view thereof; and

FIG. 3 is a plan view thereof;

DESCRIPTION OF THE PREFERRED EMBODIMENTS

Figure 1:
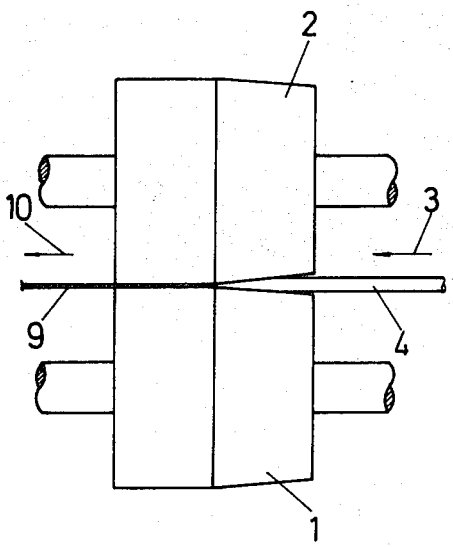

The principle of the invention will be explained hereinafter with specific reference to FIGS. 1 to 3. A pair of rolls 1 and 2 each have frusto-conical portions so that the distance between these two rolls is gradually increased toward one axial end of these rolls (FIG. 1). A round wire 4 constituting the material to be rolled is fed into the gap between the rolls 1 and 2 in the direction indicated by arrow 3. The rolls 1 and 2 are rotated reciprocatingly in the forward and backward directions as indicated by arrows 5 and 6 in FIG. 2, over a predetermined angular stroke, so that the round wire 4 is reciprocatingly moved in the laterial direction as indicated by arrow 7 in FIG. 3 after being fed in the direction of the length of the wire 4 as indictaed by arrow 8. The feeding of wire 4 is to a position laterally of and immediately adjacent the smallest dimension of the gap between the rolls 1 and 2, i.e. the upper or lower phantom line position in FIG. 3. This position is sufficiently far from the smallest dimension of the gap that the rolled and pressed wire material can be fed further in the direction of feeding. During the reciprocating movement in the lateral direction, the wire is moved to a corresponding position on the opposite side of the gap, i.e. back and forth between the phantom line positions, i.e. between the positions a and b in FIG. 2. In this way, the round wire 4 is successively flattened from its leading end and is finally taken out in the form of a tape 9 as indicated by arrow 10.

Figure 2:
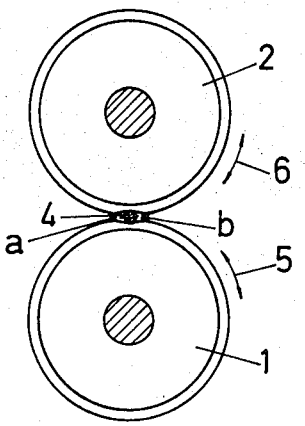
Figure 3:
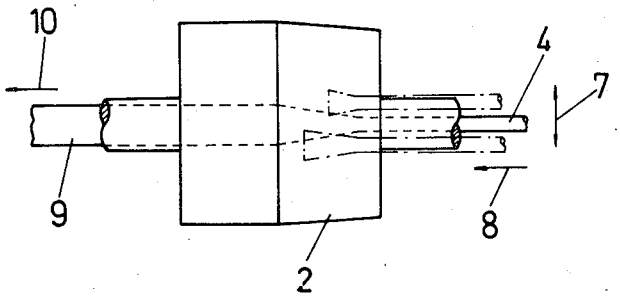

The feed of the round wire 4 has to take place when the preceding part of the wire is not being rolled, i.e. when the preceding part of the wire 4 is at the position a or b in FIG. 2 or the upper or lower phantom line position in FIG. 3. This means that the feed of the round wire 4 has to be made intermittently in synchronization with the forward and backward rotation of the rolls 1 and 2. In addition, it is necessary to feed the predetermined length of the wire as promptly as possible. From this point of view, it is preferred to adopt a system in which a force for pressing the round wire 4 in the forward direction is stored suitably and is released instantaneously when the pressurizing force is lowered, thereby to feed the wire.

An apparatus for carrying out the method of the present invention will be described hereinafter with reference to FIGS. 4 to 15.

Figure 4:
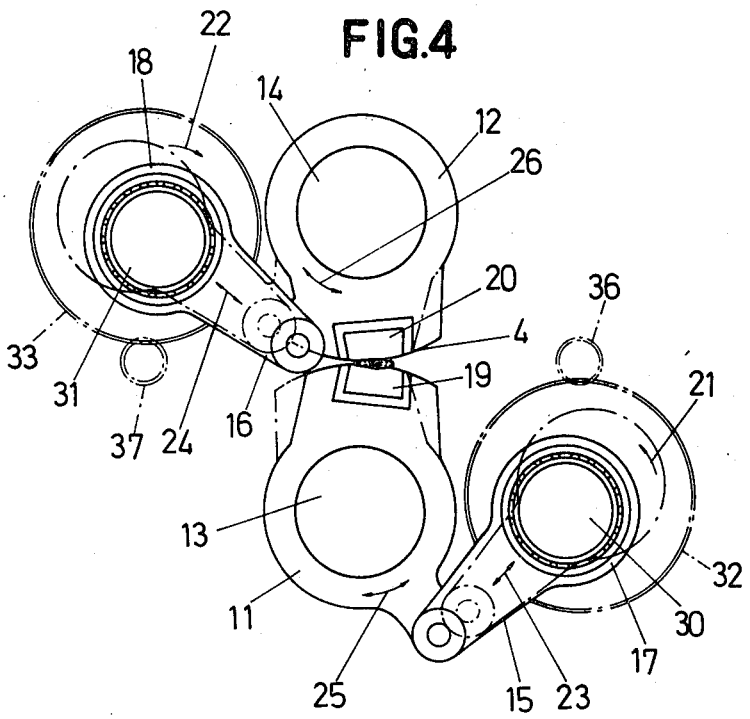
FIG. 4 is a side elevation, partly in section, showing the relationship between a pair of sector rolls and a driving device for driving the sector rolls, in the apparatus according to the present invention.
Figure 5:
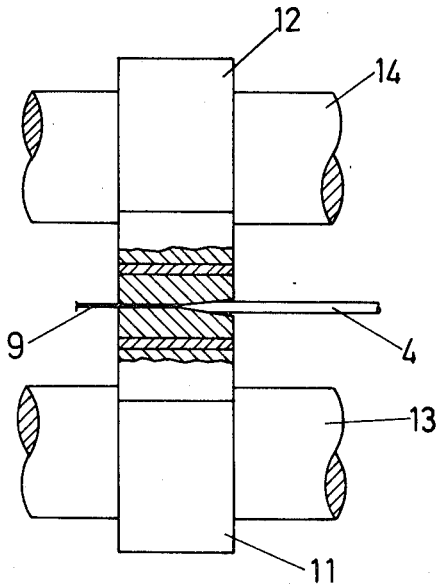
FIG. 5 is a partly broken away front elevational view of the apparatus of the invention showing the rolling of a material by a pair of sector rolls.
Figure 6:
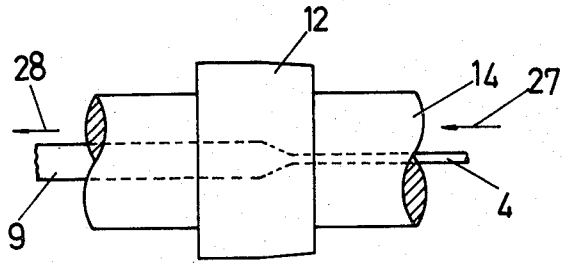
FIG. 6 is a plan view of the apparatus shown in FIG. 5.

As shown in FIG. 4, a pair of rolls 11 and 12 having sector shaped rolling surfaces (referred to as sector rolls, hereinafter) are rotatably carried at their pivot axes by means of support shafts 13 and 14, respectively. Connecting rods 15 and 16 are connected at their one ends to one side of the respective sector rolls 11 and 12 by means of pins. The other ends of the connecting rods 15 and 16 are connected to driving shafts 30 and 31 through eccentric wheels 17 and 18, respectively. Hard steel members 19 and 20 are embedded in the pressurizing surfaces of the sector rolls 11 and 12, respectively. As shown in FIG. 5, each sector roll 11 and 12 is tapered at its one side to facilitate the insertion of the round wire 4 to be rolled. In the apparatus having the above described construction, the connecting rods 15 and 16 are reciprocated as indicated by arrows 23 and 24 as the drive shafts 30 and 31 are rotated in the direction of arrows 21 and 22 in FIG. 4, so that the sector rolls 11 and 12 carry out a reciprocating rotary motion as indicated by arrows 23 and 24, respectively. Therefore, the round wire 4 fed as indicated by arrow 27 in FIG. 6 is worked from its leading end into a tape-like form and a tape 9 is taken out as denoted by an arrows 28.

Figure 7:
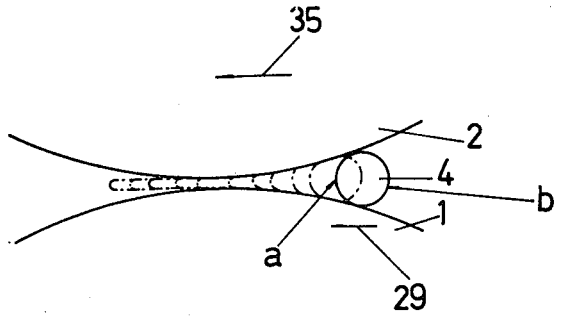
FIG. 7 illustrates a modification of a process in which a round wire is rolled into a flat wire.
Figure 8:
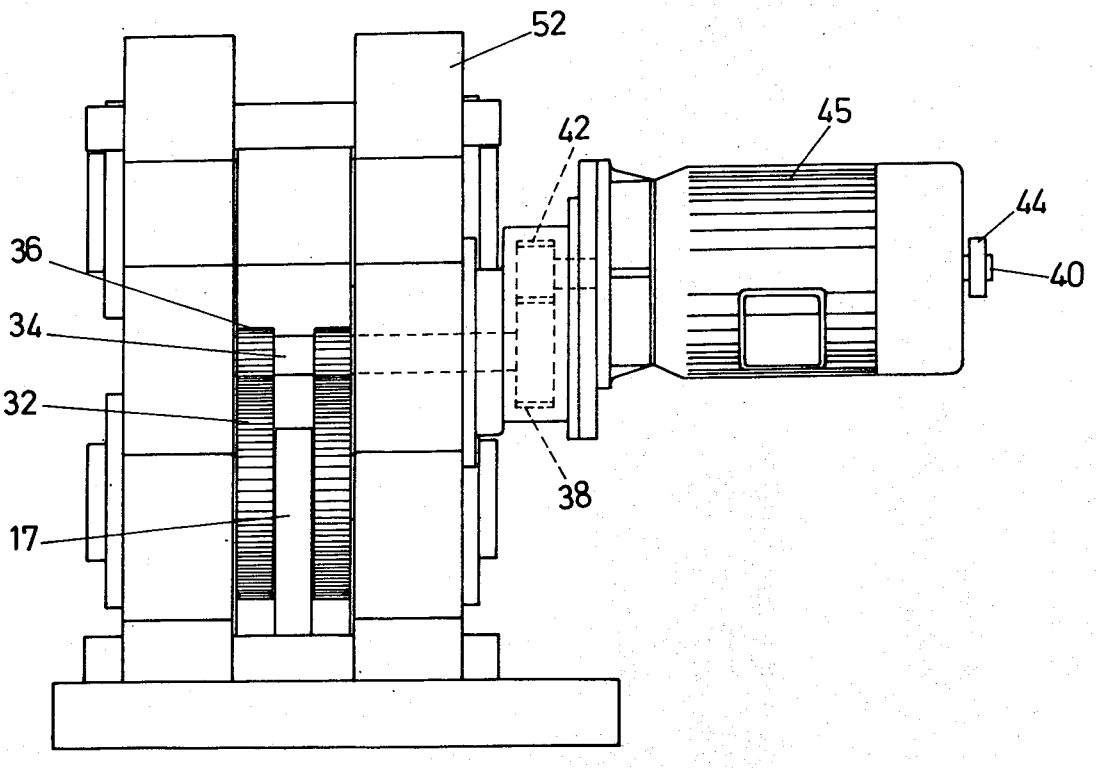
FIG. 8 is a front elevational view of an apparatus for carrying out the method of the present invention.
Figure 9:
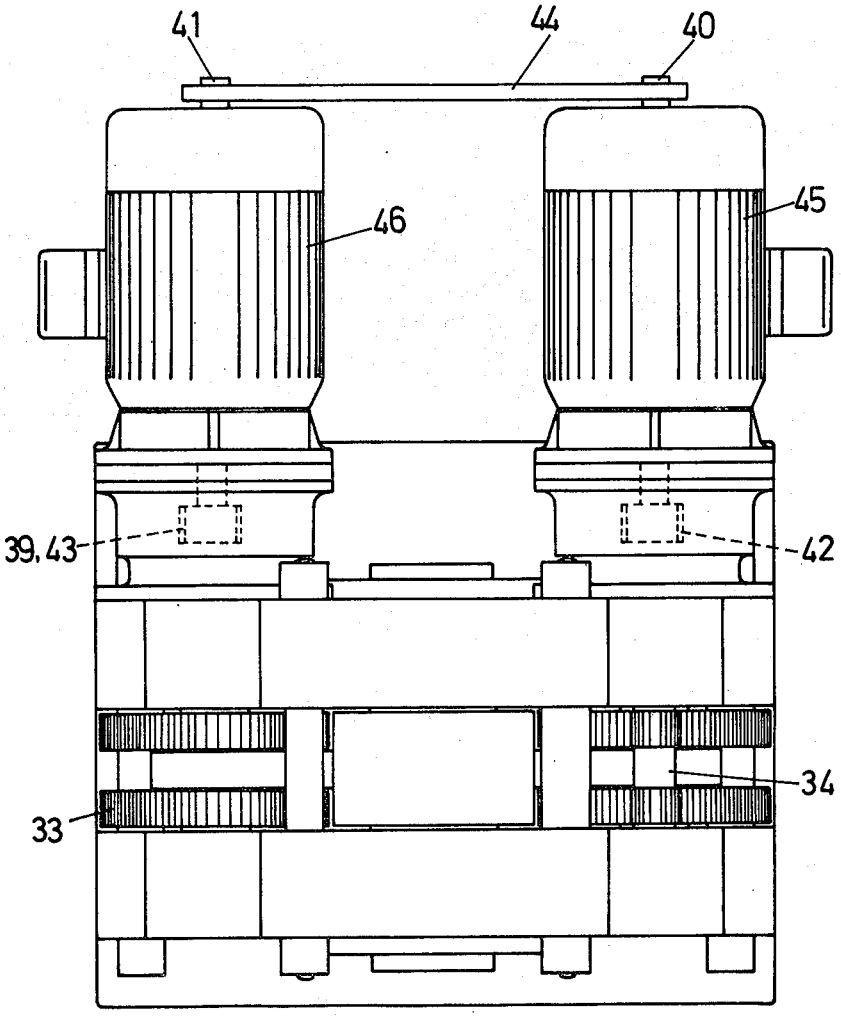
FIG. 9 is a plan view of the apparatus shown in FIG. 8.
Figure 10:
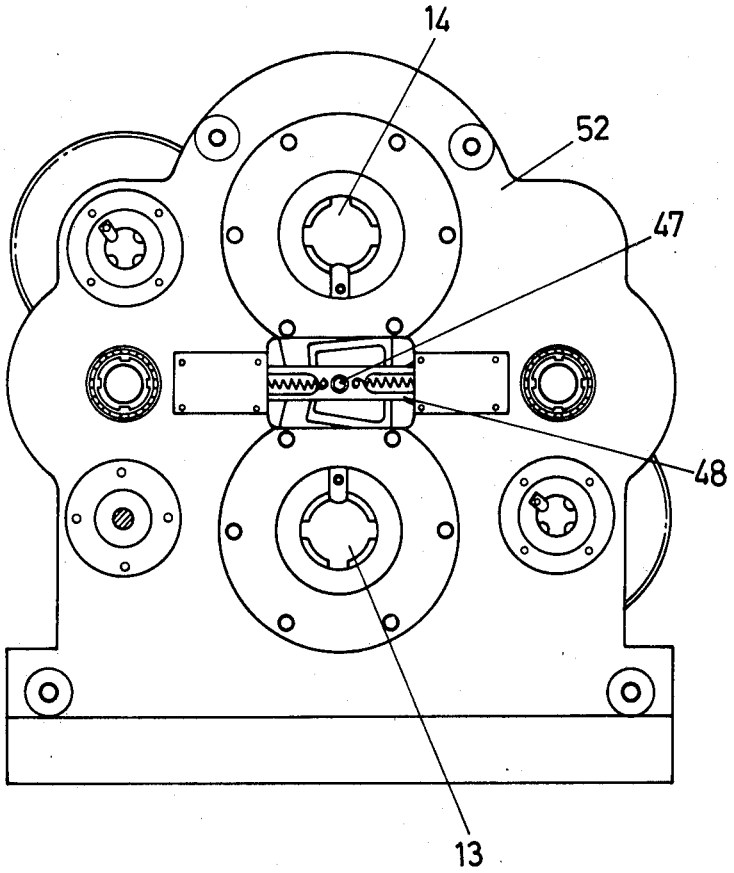
FIG. 10 is a side elevational view of the apparatus shown in FIG. 8.

As the round wire 4 is moved between the sectors rolls 11 and 12 in the direction of an arrow 29 in FIG. 7, the portion a of the round wire 4 constitutes the front side while the portion b constitutes the rear side of the tape. The rolling loads at both sides are substantially equal so that the danger of generation of cracks at the edges is avoided.

The apparatus shown in FIGS. 4 to 7 can have, for example, a practical form as shown in FIGS. 8 to 11. Namely, gears 32 and 33 are fixed to the drive shafts 30 and 31, to which the eccentric wheels 17 and 18 are connected, respectively. The gears 32 and 33 mesh with gears 36 and 37 which are fixed to the one ends of intermediate shafts 34 and 35, respectively. Gears 38 and 39 fixed to the other ends of the intermediate shafts 34 and 35 are in engagement with gears 42 and 43 which are fixed to the one ends of the shafts 40 and 41 of motors 45 and 46, respectively. A timing belt 44 is wound round the other ends of the motor shafts 40 and 41 so that both motor shafts rotate in full synchronism with each other. Since the drive shafts 30 and 31 are operatively connected to respective motors 45 and 46, respectively, through respective gears, the drive shafts 30, 31 rotate, respectively, as shown by arrows 21 and 22 as the motors 45 and 46 are started, so that the sector rolls 11 and 12 are driven respectively, in the manner explained before in connection with FIG. 4 thereby to roll the round wire 4.

Figure 12:
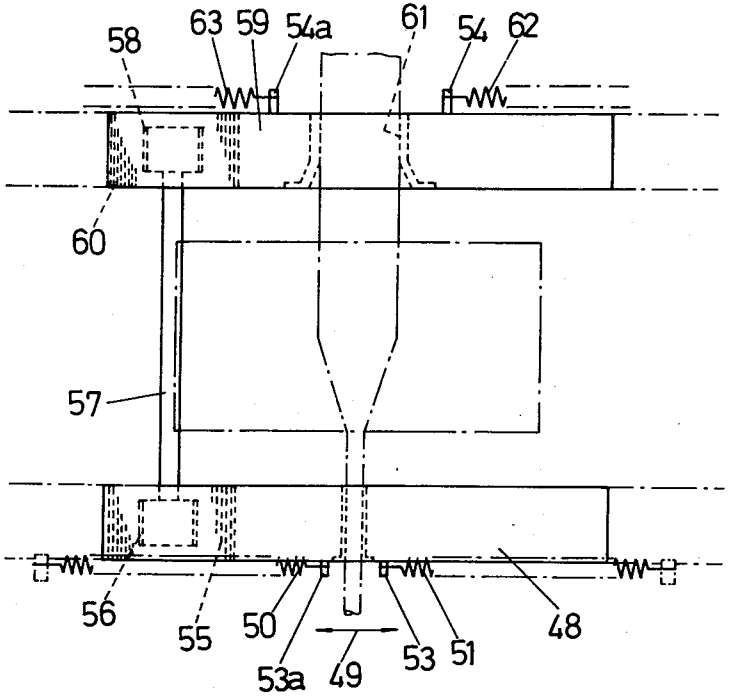
FIG. 12 is an enlarged plan view of a guiding device for the material to be rolled and the tape produced.

At the opposite side of the apparatus to the motors, i.e. at the inlet side for the round wire 4, a guide rod 48 having a guide bore 47 for guiding the round wire 4 is mounted for free horizontal sliding motion in the direction of arrow 49 in FIG. 12. As shown in detail in FIGS. 12 and 13, coil springs 50 and 51 are connected to the guide rod 48 for biasing the latter to the left and right, respectively. More specifically, these springs 50 and 51 are stretched between the housing 52 and tabs 53 and **53*a*, respectively. The guide rod 48 is provided at its one end with a rack 55 which engages a pinion 56 fixed to one end of a pinion shaft 57. The pinion shaft 57 is mounted horizontally on the housing. The other end of the pinion shaft 57 at the other side (same side as motor) of the housing 52 fixedly carries a pinion 58 which in turn engages with a rack 60 of the guide rod 59 provided at the tape outlet side. A guide groove 61 of the same breadth as the tape 9 is provided at the center of the guide rod 59. The guide rod 59 is mounted for sliding motion in horizontal directions and is biased to the left and right by means of tension coil springs 62 and 63 stretched between the tabs 54 and 54*a*** and the housing.

Figure 14:
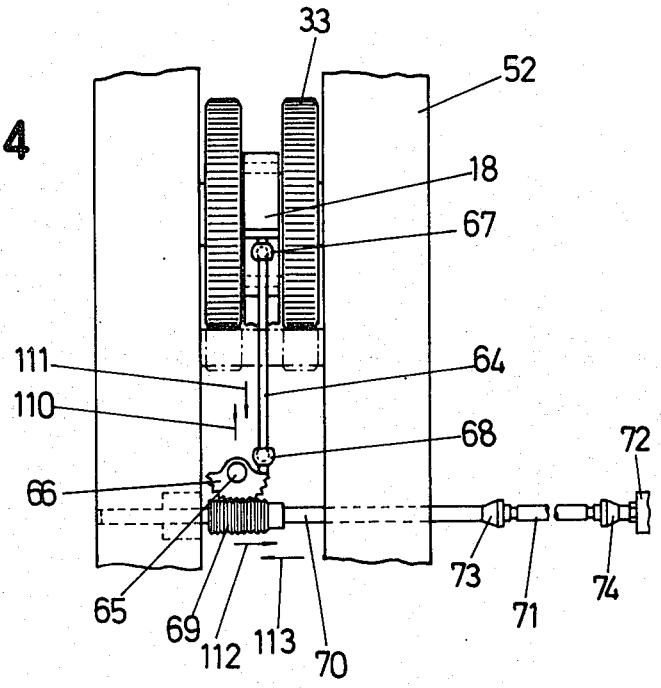
FIG. 14 is a front elevational view of a power transmission mechanism for the intermittent material feeding device.
Figure 15:
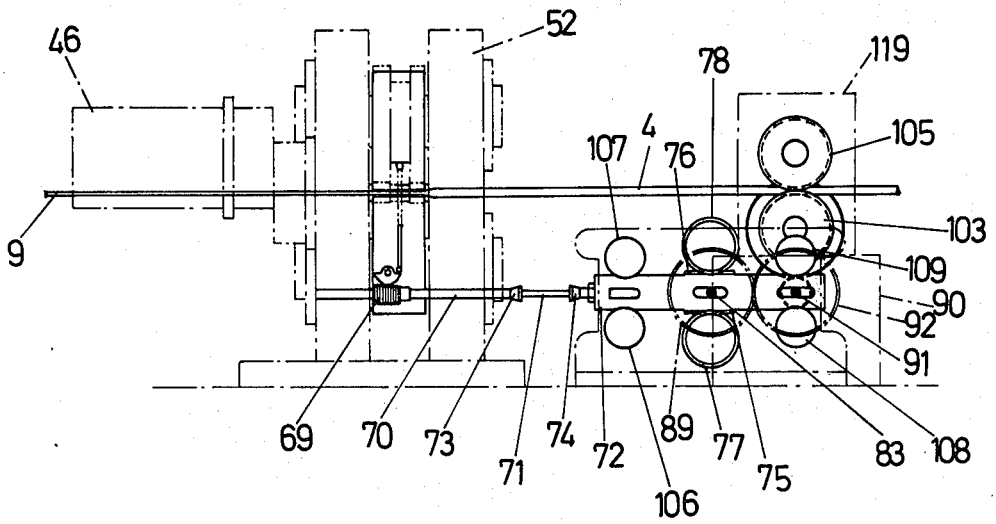
FIG. 15 is a front elevational view of a part of the apparatus embodying the invention showing particularly the relationship between the rolling device and the material feeding device.

A rod 64, see FIG. 14, is connected through a universal joint 67 to the outer wall of the eccentric wheel 18, while the lower end of the rod 64 is eccentrically connected through a universal joint 68 to a sector gear 66 on a support shaft 65 mounted horizontally on the housing. The aforementioned sector gear 66 meshes with the rack 69 of an operation lever 70 mounted on the housing in parallel with the aforementioned drive shaft 31.

An intermittent material feeding device will be described hereinunder with reference to FIGS. 14 to 21. The aforementioned operation lever 70 is provided as input means for the device for feeding the round wire 4, and is connected to an input lever 72 of an intermittent feeding device through a connecting lever 71 and universal joints 73, 74.

The input lever 72 is provided at its upper and lower faces with racks 75 and 76 meshing with pinions 77 and 78. Pinion shafts 79 and 80 have gears 81 and 82 which are in engagement with a gear 88 of an intermediate shaft 83. The aforementioned gears 81 and 82 are connected through free wheels 84 and 85 to pinion shafts 79 and 80 respectively. These members in combination constitute a one-way clutch which transmits the power only when the gears 81 and 82 rotate in the directions of arrows 86 and 87 in FIG. 16 respectively. A gear 89 is fixed to the above-mentioned intermediate shaft 83. The gear 89 is in engagement with a gear 92 which is mounted on a pinion shaft 91 mounted on a housing 90 horizontally and in parallel with the intermediate shaft 83. The gears 89 and 92 are replaceable as a unit so as to provide different rotation speeds. It is, therefore, possible to control the amount of rod fed by the pinch rolls by selecting the appropriate combination of the gears 89 and 92. A pinion 93 is fixed to one end of the pinion shaft 91. The pinion 93 engages a gear 95 which is freely mounted on a pinch roll shaft 94. Three projections 96 are provided at a constant circumferential pitch on one side of the gear 95. Each projection 96 carries a pin 97 which extends in parallel with the pinch roll shaft 94.

A boss 98 is also fixed to the pinch roll shaft 94. A number of projections 99 corresponding to the number of the aforementioned projections 96 are formed on one side surface of the boss 98 at a constant circumferential pitch. Each projection 99 carries a pin 100. The pins 97 and 100 of the corresponding projections 96 and 99 constitute a pair, and springs 101 are provided for each pair of pins. In the illustrated embodiment, 6(six) springs are used for 3 pairs of pins 97 and 100. More specifically, one of the springs 101 is fixed at its one end to the pin 97, while the other end of the same is fixed to the pin 100. Thus, the springs 101 are provided to produce a rotation of the boss 98 by an angle equal to that of rotation of the gear 95. This means that rotation energy or force is stored in the springs 101 when the boss 98 is prevented from rotating following the rotation of the gear 95.

Figure 16:
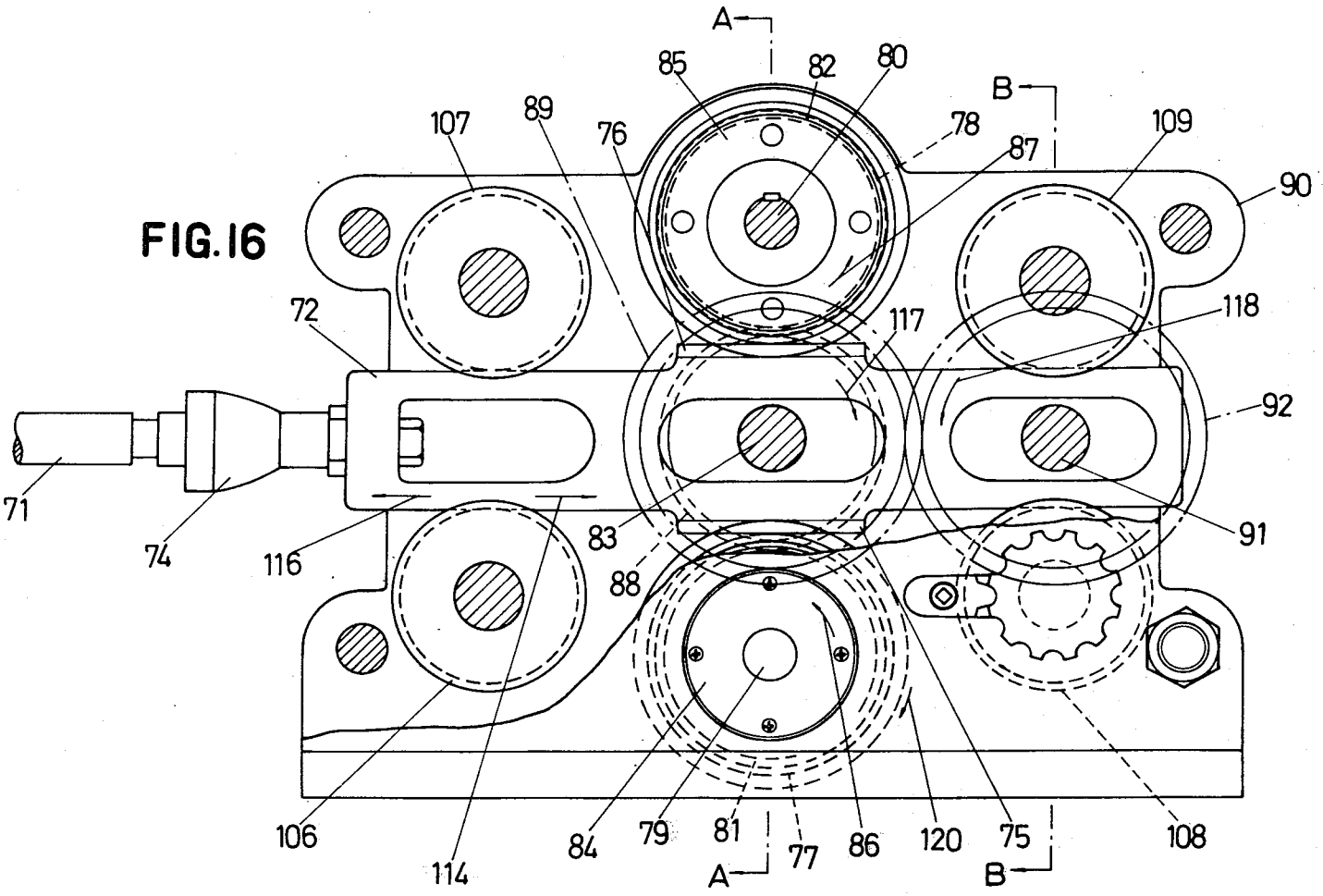
FIG. 16 is a partial sectional enlarged view of the material feeding device.
Figure 17:
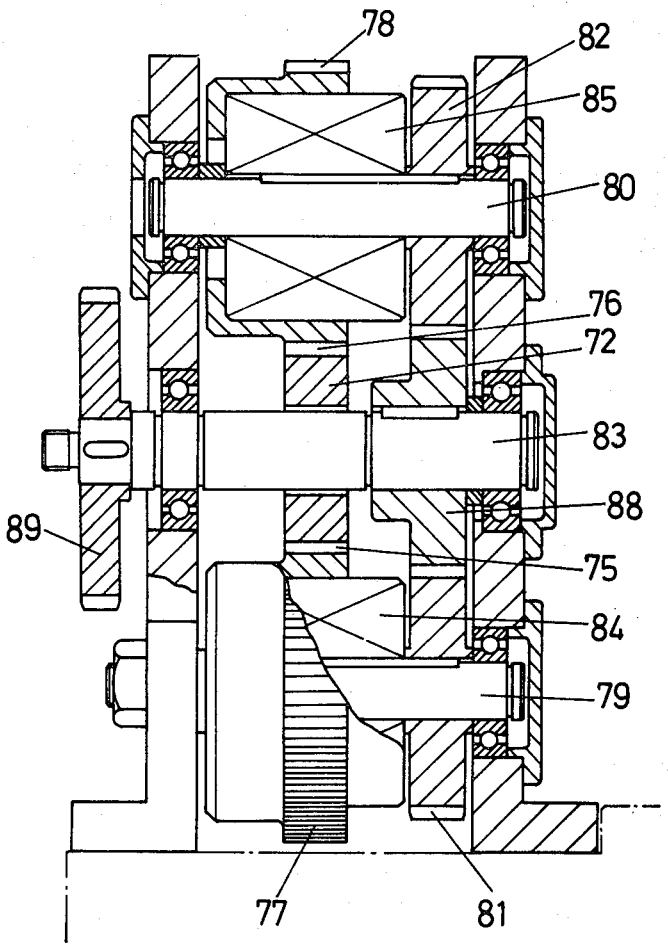
FIG. 17 is a sectional view taken along the line A—A of FIG. 16.
Figure 18:
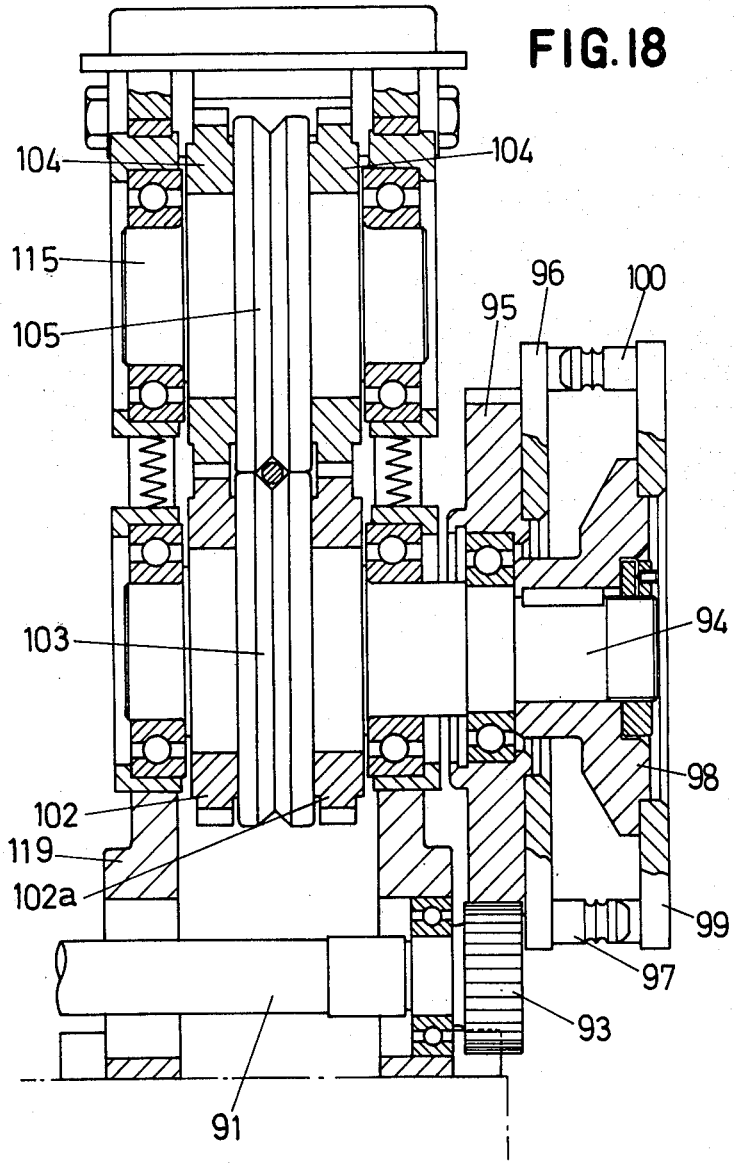
FIG. 18 is a side elevational view, partly in section, showing the state of mounting of pinch rolls in the material feeding device.
Figure 19:
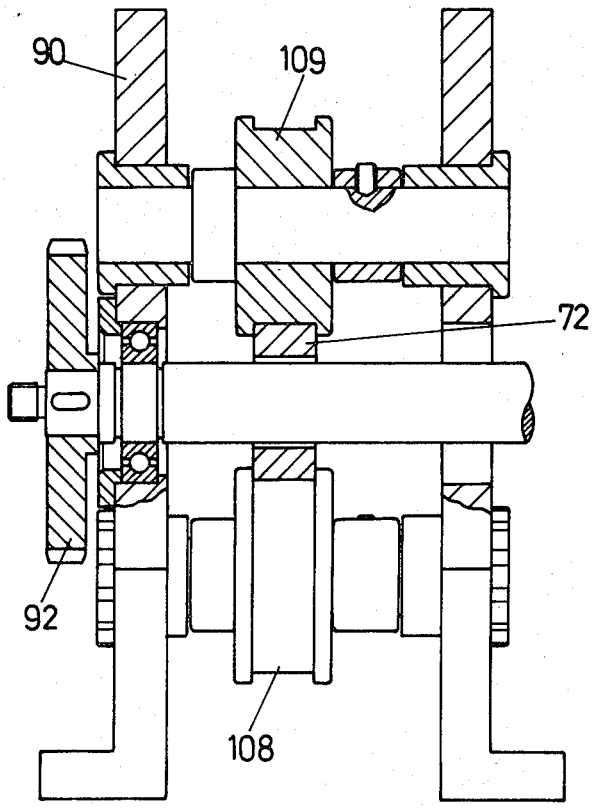
FIG. 19 is a sectional view taken along the line B—B of FIG. 16.
Figure 20:
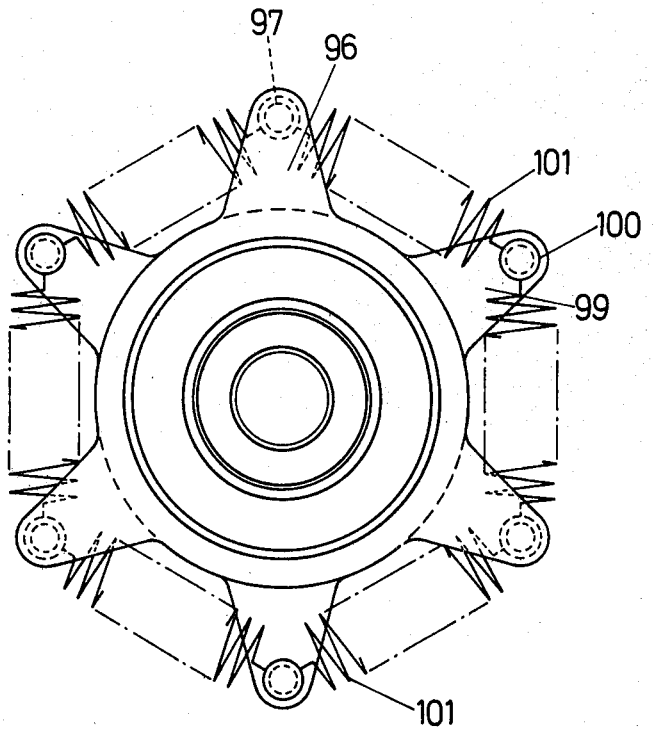
FIG. 20 is an enlarged side elevational view of a power storage device for the material feeding device.
Figure 21:
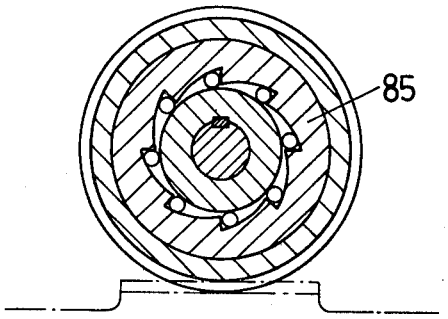
FIG. 21 is a sectional view of one side of a face wheel.

Interconnecting gears 102 and **102*a* and a pinch roll 103 are fixed to the pinch roll shaft 94. The interconnecting gears 102 and 102*a* are in engagement with gears 104 and 104*a* of a pinch roll shaft 115 which is mounted on a housing 119 in parallel with the pinch roll shaft 94. A pinch roll 105 for cooperation with the aforementioned pinch roll 103 is fixed to the pinch roll shaft 115. In FIG. 16, reference numerals 106, 107, 108 and 109** denote guide rolls for the input lever.

Figure 11:
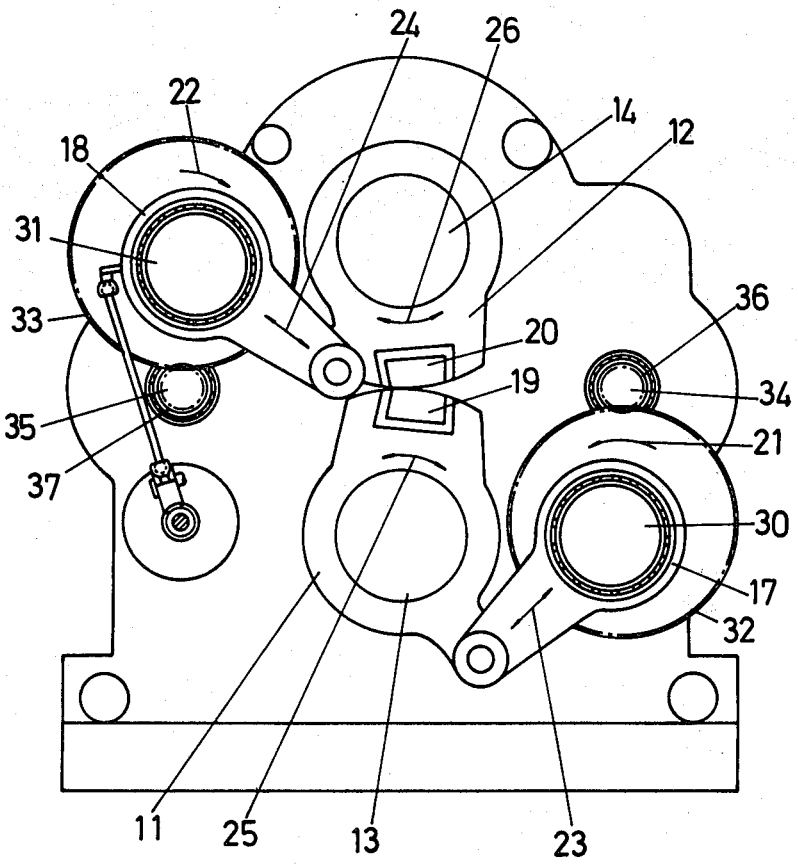
FIG. 11 is a side elevational view of a rolling pressurizing member, a driving device for the same and a mechanism for producing the power for intermittent feed of the material.
Figure 13:
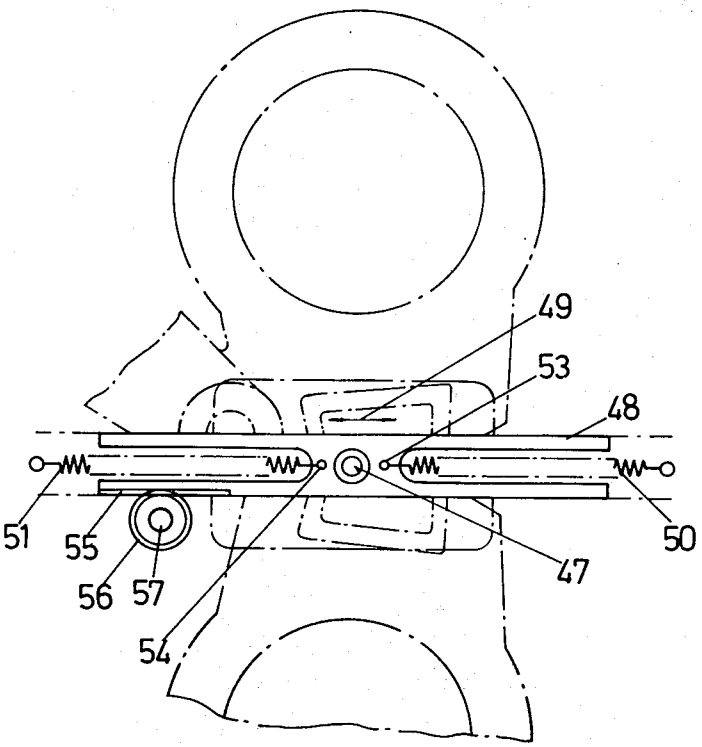
FIG. 13 is an enlarged sectional view of the material inlet side portion of the guiding device.

The operation will be explained hereinafter with reference to the drawings. Referring first to FIG. 11, as the drive shaft 31 makes one rotation, the rod 64 is moved up and down as indicated by arrows 110 and 111 in FIG. 14. The sector gear 66 makes one cycle of reciprocating rotation as the rod 64 completes one cycle of reciprocating movement. This operation is transmitted through the rack 69 to the operation rod 70 so that the latter makes one full rotation. In consequence, the input lever 72 connected to the operation rod 70 makes one reciprocating motion. For instance, as the input rod 72 makes a movement in the direction of arrow 114 in FIG. 16, the gear 78 rotates in the direction of arrow 87 through engagement with the rack 76, so that a driving torque is transmitted to the pinion shaft 80 through the free wheel 85. The torque is then transmitted to the intermediate shaft 83 through the gear 82 and the gear 88 meshing with the latter. The torque is further transmitted through the gear 89 of the intermediate shaft 83 and the gear 92 of the pinion shaft meshing with the gear 89 to the pinion shaft 91 to rotate the latter in the direction of an arrow 118. As the pinion shaft 92 rotates, the pinion 93 is rotated in the same direction to rotate the gear 95 which in turn rotates the boss 98 through the projections 96, pins 97, springs 101, pins 100 and the projections 99. The rotation of the boss 98 is then transmitted to the pinch roll shaft 94 to rotate the pinch roll 103. The rotation of the pinch roll shaft 94 is, on the other hand, transmitted to the pinch roll shaft 105, through engagements between the gears 102 and **102*a* and the gears 104 and 104*a*. Thus, the pinch roll shafts 103 and 105 cooperate with each other in driving the round wire 4**.

As the input lever 72 is moved in the direction of the arrow 114, the gear 77 is rotated in the direction of the arrow 120 by means of the rack 75. The rotation of the gear 77, however, is not transmitted to the pinion shaft 79 because of the presence of the free wheel 84, so that the meshing between the gear 81 and the gear 88 is made without any trouble.

On the other hand, as the input lever 72 is moved in the direction arrow 116 in FIG. 16 on its returning stroke, the rotation of the rack 75 and the pinio 77 in the direction of arrow 86 is transmitted to the pinion shaft 79 through the free wheel 84. This rotation is transmitted further to the gear 88 of the intermediate shaft 83 through the gear 77 fixed to the pinion shaft 79 so that the gear 88 is rotated in the direction of arrow 117 in FIG. 16. In consequence, the gear 92 of the pinion shaft 91 is rotated through the action of the gear 89, in the direction of arrow 118. Thereafter, the pinch rolls 103 and 105 are rotated as in the case of the power input through the pinion shaft 80.

In the apparatus of the invention, the feed of the round wire 4 has to be made when the latter is not being pressed by the sector rolls, i.e. during a time other than the rolling period. In addition, the feed of the round wire has to be made instantaneously and without fail. According to the invention, the springs 101 conveniently store the feeding energy so as to continuously urge the round wire. Therefore, at the instant at which the round wire is relieved from the rolling pressure, the pinch rolls are rotated by the energy stored by the springs 101, so that the round wire is fed instantaneously and without delay.

Although round wire is used as the material in the described embodiment, needless to say, the invention can be carried out with the wire materials having various cross-sectional shapes such as angular cross-section, oval cross-section, flat cross-section and so forth. It is of course necessary that the cross-section of the groove in the pinch rolls correspond to the shape of the cross-section of the wire.

In the described embodiment, the transmission of power between the motor and the drive shaft is achieved by a gear train. This, however, is not essential and the described gear train can be replaced by another suitable power transmission mechanisms.

The described arrangement for driving the pinch rolls, in which the rotation of the eccentric wheel is transmitted to the input lever of the pinch roll driving mechanism through a series of transmission members such as a rod, sector gear, rack and connecting rod, is not essential and can be modified suitably.

A practical example of production of a metallic tape in accordance with the method of the invention will be explained hereinunder.

A round wire of 5.5 mm dia (cross-sectional area 23.74 $mm^2$ tensile strength 105 $kg/mm^2$, SK-5, fine pearlite structure after heat treatment) was fed intermittently. The stroke at each feed step was 10 mm. A 16% area reduction was effected by one pass of the material. This means that about 16% of the material was caused to flow in the axial or longitudinal direction of the roll. And the tensile strength was 144 $kg/mm^2$ after the pass of the wire. Further tape thus worked was then subjected to a 45% rolling in the direction perpendicular to the direction of the first rolling, i.e. in the conventional rolling direction to reduce the thickness down to 0.55 mm. Then the tensile strength of this rolled tape was 166 kg/mm$^2$. Thickness of the mid portion of the cross-section perpendicular to the longitudinal axis of the tape was about 3% greater than that at both lateral ends of the same cross-section, but no cracking was observed in either of the lateral edges. The processing speed for producing a tape 20 mm wide and 1 mm thick from a round wire of 5.5 mm dia. was 10 m per minute. The angle of taper in the roll was 1°.

Thus, according to the method of the invention, the material wire to be worked is fed into the gap between a pair of rolling and pressing members in a direction parallel to the rolling axis of these members. The rolling and pressing members are reciprocatingly rotated through a predetermined angle while the wire is successively worked from its leading end. And the material can easily be rolled in the breadthwise direction thereof irrespective of the cross-sectional shape of the wire and the plastic flow of the material of the wire in the axial direction, i.e. the axial elongation, is minimized as much as possible. At the same time, the undesirable corrugation or irregularity and cracking in the longitudinal edges are completely eliminated, so that a tape having a good quality can be produced continuously. In addition, since the wire is fed intermittently when there is no rolling pressure acting on the material wire, the wire can be correctly fed at a constant pitch and stroke to further ensure the high quality of the product.

Further, in the apparatus for carrying out the method of the invention, a pair of rolling and pressing members are carried by parallel shafts such that their working surfaces oppose each other. At the same time, the guide member for the material to be worked and the guide member for the product are driven in synchronization with each other, so that the wire to be rolled and the tape produced are oscillated correctly without receiving any unreasonable force to facilitate the rolling. In addition, the intermittent wire feeding device operates in synchronism with the rolling operation of the rolling and pressing operation of the rolling and pressing members, so that the feeding force can be stored just before the release of the material wire from the rolling force and is relieved simultaneously with the release of the wire to instantaneously feed the material.

What is claimed is:

1. An apparatus for producing metallic tape, comprising:

a machine frame;

a pair of support shafts mounted on said machine frame and extending parallel with each other;

a pair of rolling and pressing members each having a base rotatably mounted on a corresponding support shaft and each having a peripheral portion projecting substantially radially outwardly from said base with a peripheral working surface on the radially outer end thereof, said peripheral working surfaces the radially outer end thereof, said peripheral working surfaces of said rolling and pressing members being opposed to each other;

a pair of power input members operable in synchronism with each other and connected to respective ones of said rolling and pressing members for reciprocally rotating said rolling and pressing members past a position in which the peripheral portions are aligned with each other between said parallel shafts;

a wire feed means for intermittently feeding a wire between said peripheral working surfaces parallel to said support shafts in a direction from an inlet side of said rolling and pressing members to an outlet side of said members;

a wire guiding member disposed on the inlet side of said rolling and pressing members; and a product tape guiding member disposed on the outlet side of said rolling and pressing members, said guiding members being reciprocatingly movable in a direction perpendicular to a plane including the axes of said support shafts and in synchronism with the intermittent feeding of said wire for guiding the wire fed back and forth between said peripheral working surfaces in a direction perpendicular to said shafts, the distance between said peripheral working surface progressively decreasing at least part way across said peripheral working surfaces in the direction from said inlet side to said outlet side.

2. An apparatus as claimed in claim 1 further comprising independent motors operable in synchronism with each other and to the output shafts of which said power input connecting members are drivingly connected.

3. An apparatus as claimed in claim 1 in which each of said rolling and pressing members has a sector-shaped peripheral working surface tapered in the axial direction toward said inlet side from about midway of the distance across said working surface and is rotatably supported at the apex of the sector-shaped peripheral working surface.

* * * * *